US006321805B1

(12) United States Patent
Suggs

(10) Patent No.: US 6,321,805 B1
(45) Date of Patent: Nov. 27, 2001

(54) GOLF CLUB HEAD COVER AND METHOD OF MAKING SAME

(75) Inventor: Gregory M. Suggs, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 09/469,943

(22) Filed: Dec. 21, 1999

(51) Int. Cl.[7] ..... A63B 57/00
(52) U.S. Cl. ..... 150/160
(58) Field of Search ..... 150/160

(56) References Cited

U.S. PATENT DOCUMENTS

| | | | | |
|---|---|---|---|---|
| 2,115,307 | * | 4/1938 | Kneeter | 150/160 |
| 2,526,985 | * | 10/1950 | Whitehead | 150/160 |
| 3,051,210 | * | 8/1962 | Mesinger | 150/160 |
| 3,294,138 | * | 12/1966 | Pawly | 150/160 |
| 3,303,865 | * | 2/1967 | Ouimet | 150/160 |
| 3,938,570 | * | 2/1976 | Stewart | 150/160 |
| 3,965,955 | * | 6/1976 | Price | 150/160 |
| 4,667,716 | | 5/1987 | Solheim | 150/160 |
| 4,991,338 | * | 2/1991 | Jones | 150/160 |
| 5,284,194 | | 2/1994 | Gaffney . | |
| 6,095,214 | * | 8/2000 | Gaffney | 150/160 |

* cited by examiner

*Primary Examiner*—Gregory M. Vidovich
*Assistant Examiner*—Maerena W. Brevard
(74) *Attorney, Agent, or Firm*—Darrell F. Marquette

(57) ABSTRACT

A head cover for covering a head and an adjacent shaft portion of a golf club including an outer sleeve and an inner liner each of which has a generally tubular configuration with a closed upper end and open bottom end. The open bottom ends of the outer sleeve and the inner liner are sewn together with an inverted V-shaped slot extending from the open bottom ends toward the closed upper ends thereof. The longitudinal dimension of the inner liner is less than the longitudinal dimension of the outer sleeve to provide a gap between the closed upper ends of the inner liner and the outer sleeve. When installed on a golf club, the head of the golf club pushes the closed upper end of the inner liner into engagement with the closed upper end of the outer sleeve closing the gap and partially closing the open bottom end of the inner liner. This closes the inverted V-shaped slots in the outer sleeve and the inner liner. The golf club head cover may be provided with a detachable identification tag.

5 Claims, 6 Drawing Sheets

GOLF CLUB HEAD COVER AND METHOD OF MAKING SAME

BACKGROUND OF THE INVENTION

This invention relates in general to golf equipment and, more particularly, to an improved golf club head cover and a method of making the same.

It is a common practice to use head covers on golf clubs, particularly on those clubs referred to as "woods", to protect them from damage when not in use. These head covers are usually made of flexible material such as fabric and are of a generally tubular configuration with one end being open and the other end being closed. There are two basic types of head covers currently in use with an older design being intended for use on woods having steel shafts and a newer design specially designed for use on woods having graphite shafts. The head covers normally used on steel shafted woods are relatively short since steel shafts do not require any special protection. An example of this type of prior art head cover is disclosed in U.S. Pat. No. 4,667,716 to John A. Solheim et al.

Unlike their steel shafted counterparts, woods having graphite shafts need special protection for the graphite shafts when they are carried in golf bags. When golf clubs are placed in a golf bag, the golf club heads extend above the top of the golf bag and the golf club shafts are surrounded by and divided into groups by a throat structure including an outer rim and divider bars. U.S. Pat. No. 4,596,328 to John A. Solheim discloses a typical throat structure. Any movement of the golf clubs in the golf bag, such as occurs when the golf bag is being carried, will cause the golf club shafts to rub against the outer rim and the divider bars of the throat structure. In the absence of some form of protection, this rubbing will result in abrasive damage to graphite shafts which mars their appearance.

To alleviate the abrasive damage problem to graphite shafts, the newer design of prior head covers, which are sometimes referred to simply as "graphite head covers", are considerably longer than the head covers used on steel shafted clubs. The additional length of the graphite head covers are intended to cover portions of the graphite shafts which extend down through the throat structure of the golf bag and thus shield those shaft portions from abrasive damage. These prior graphite head covers include a pouch-shaped upper portion for containing a golf club head and a tail portion depending from the upper portion. The pouch shaped upper portion is usually made of flexible material, such as synthetic leather, and the tail portion is of knitted construction which expands and contracts when a golf club head is passed through it as the head cover is installed on or removed from a golf club. Since the tail portion is knitted, it will only expand to a limited extent and although it is relatively slim in comparison to the pouch shaped upper portion, it must be large enough to allow passage of the golf club head. As these prior graphite head covers are used, repeated stretching of the knitted tail portion will cause it to lose its elasticity and when this occurs, the tail portion will permanently increase in diameter.

A golfer frequently cares three or four wood type dubs in a golf bag, and the section of the throat structure in which these clubs are carried is rather crowded when the prior graphite head covers are used. Such crowding often causes the tail portions of the graphite head covers to catch on the outer rim or the divider bars of the throat structure when the clubs are inserted into the golf bag. This problem is aggravated as the tail portions become stretched with use. When these tail portions catch on the throat structure as the clubs are inserted into the golf bag, the tail portions ride up on the shafts and remain bunched up above the throat structure. This, of course, defeats the primary purpose of the tail portions of the graphite head covers.

SUMMARY OF THE INVENTION

A head cover according to the present invention is formed with an outer sleeve and an inner liner both of which are configured to provide the head cover with an elongated receptacle having an upper pocket for containing a head of a golf club and a lower pocket for containing a portion of a shaft adjacent the golf club head. The golf club head passes through the lower pocket when the head cover is installed on or removed from the golf club. The outer sleeve and the inner liner are of unique configuration and are sewn together in a special manner so that the lower pocket is normally open to allow passage of the golf club head but closes about the adjacent shaft portion when the golf club head enters the upper pocket.

In the preferred embodiment of the head cover, both the outer sleeve and the inner liner are of generally tubular configuration with a closed upper end and an open bottom end. Furthermore, the outer sleeve and the inner liner each have an inverted V-shaped slot extending from the open bottom end toward the closed upper end. The outer sleeve has a first longitudinal dimension, and the inner liner has a second longitudinal dimension which is less than the first longitudinal dimension so that a gap is provided between the closed upper ends of the outer sleeve and the inner liner. When the head cover is installed on a golf club head, the inner liner closed upper end is pushed toward the outer sleeve closed upper end to close the gap and partially close the open bottom end of the inner liner. This closes the inverted V-shaped slots in the inner liner and the outer sleeve which closes the lower pocket.

DESCRIPTION OF THE PREFERRED EMBODIMENT

Figure 3A:
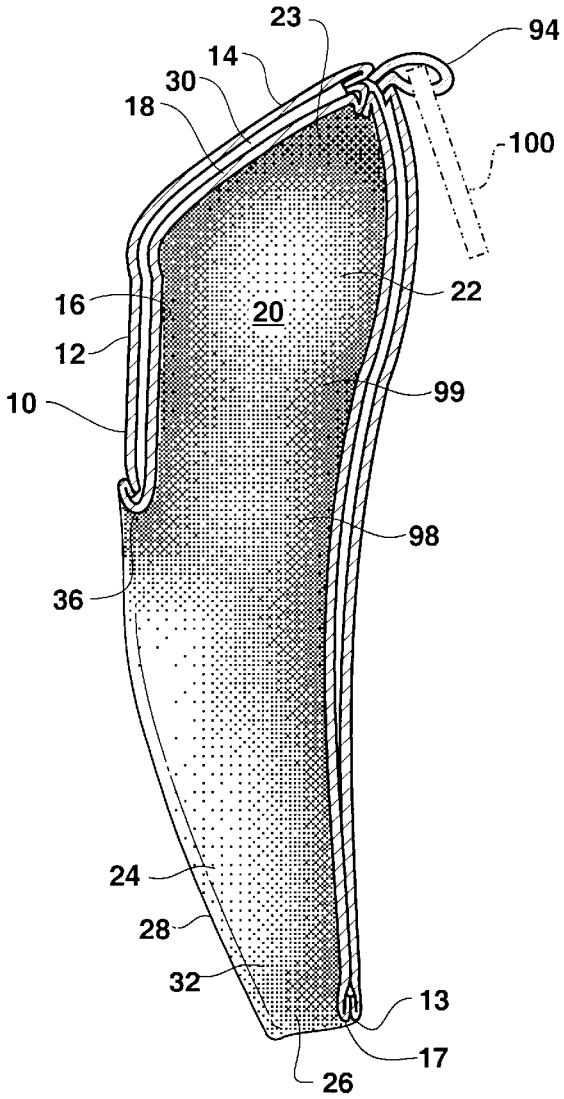
FIG. 3*a* is a sectional view taken along lines 3*a*—3*a* in FIG. 1.

Referring to the drawings, FIGS. 1, 2, 3*a* and 3*b* show a head cover according to the present invention which is indicated generally by the reference numeral 10. The head cover 10 includes an outer sleeve 12 which is elongated and of generally tubular configuration having a closed upper end 14. An inner liner 16 which is disposed within the outer sleeve 12 is also elongated and of generally tubular configuration with a closed upper end 18. The outer sleeve 12 and the inner liner 16 have respective open bottom ends 13 and 17 as best seen in FIG. 3*a*. The outer sleeve 12 and the inner liner 16 cooperatively provide the head cover 10 with an elongated receptacle 20 which has an upper pocket 22 at one end 23 and a lower pocket 24 at the other end 26. The outer sleeve 12 and the inner liner 16 each have an inverted V-shaped slot at 28 extending from their respective open bottom ends 13, 17 toward their respective closed upper ends 14, 18.

Figure 1:
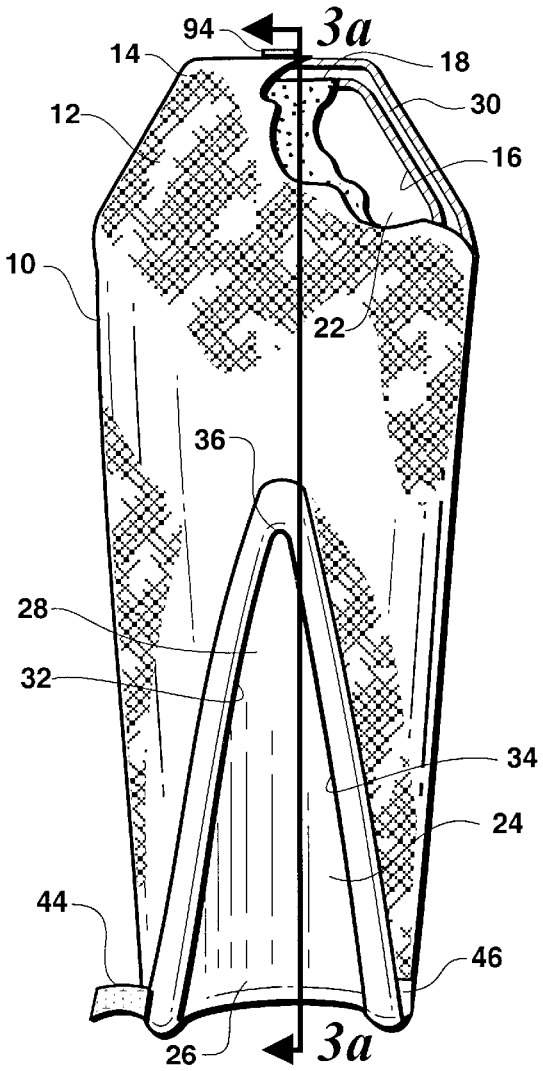
FIG. 1 is an elevational view of a golf club head cover according to the present invention in a relaxed condition when not in use on a golf club with portions thereof partially broken away.

As described later, the outer sleeve 12 and the inner liner 16 are sewn together in a special manner, and the inner liner 16 has a longitudinal dimension that is less than a longitudinal dimension of the outer sleeve 12 to provide a gap 30 between the closed upper end 14 of the outer sleeve 12 and the closed upper end 18 of the inner liner 16. In FIG. 1, the head cover 10 is shown in a relaxed condition when not in use on a golf club. When the head cover 10 is in this relaxed condition, edges 32 and 34 which define the inverted V-shaped slots at 28 in the outer sleeve 12 and the inner liner 16 diverge downwardly from an apex 36 toward the end 26 of the receptacle 20.

Figure 2:
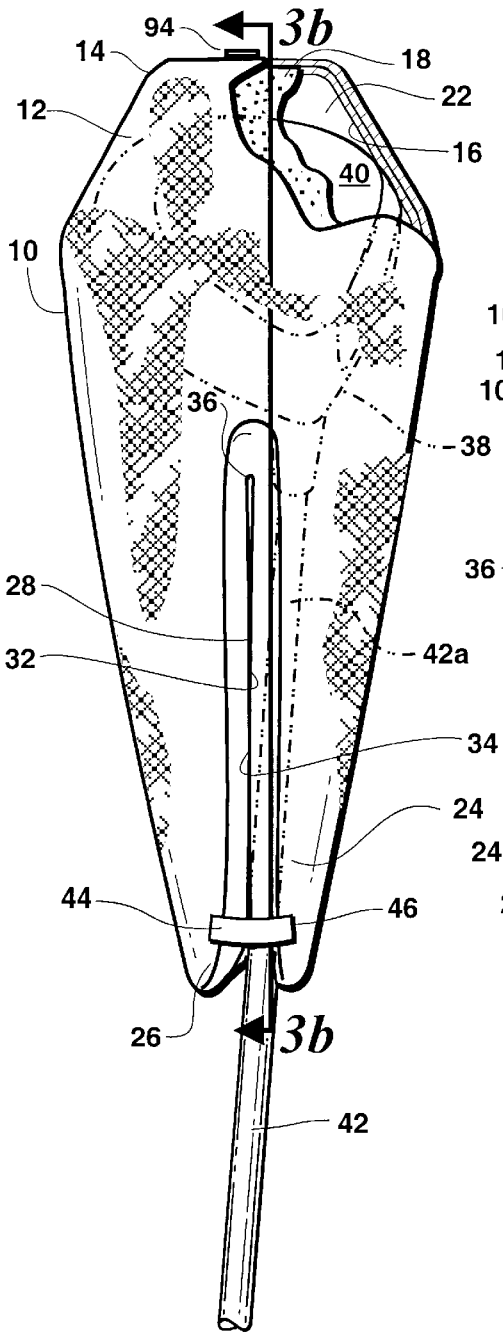
FIG. 2 is a view similar to FIG. 1 showing the golf club head cover in use on a golf club.
Figure 3B:
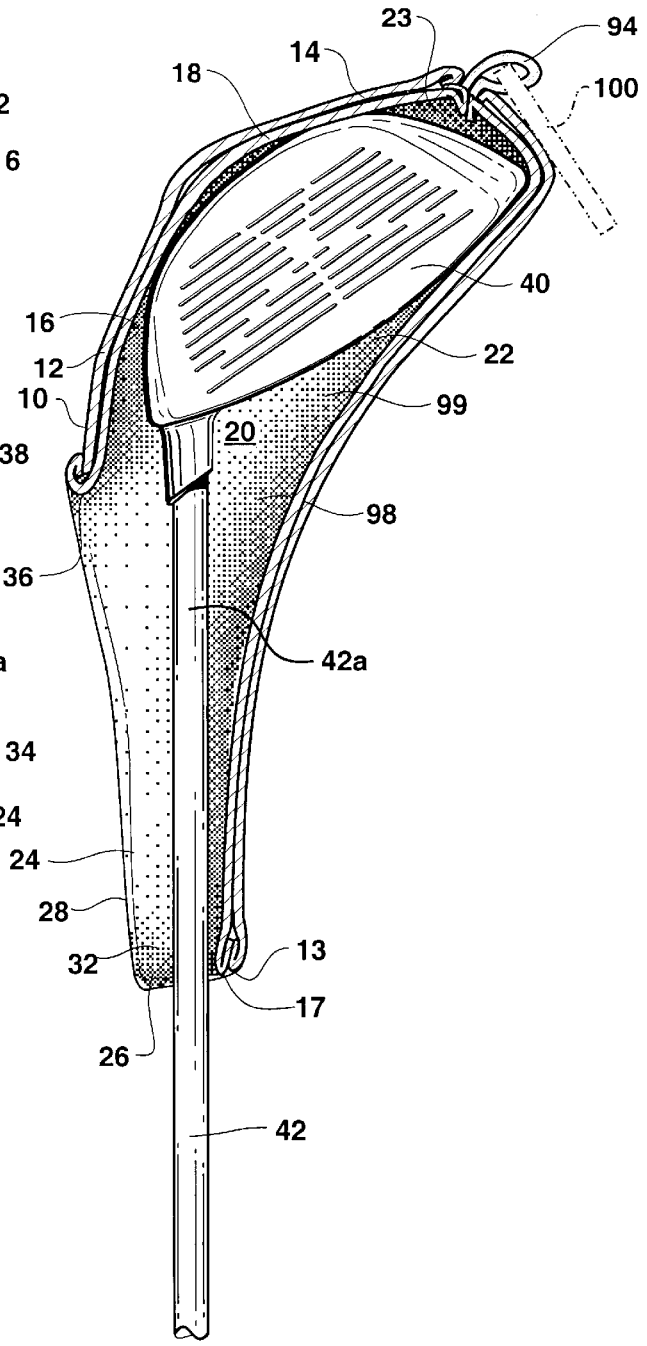
FIG. 3*b* is a sectional view taken along lines 3*b*—3*b* in FIG. 2.

When the head cover 10 is installed for use on a golf club 38 having a head 40 and a shaft 42 as shown in FIG. 2, the head cover 10 is pulled downwardly over the head 40 until the head 40 is in the upper pocket 22 and engages the closed upper end 18 of the inner liner 16. This pushes the closed upper end 18 of the inner liner 16 against the closed upper end 14 of the outer sleeve 12 and thereby closes the gap 30. Closing the gap 30 causes the inner liner 16 to pull the edges 32 and 34 toward each other partial closing the open bottom end 17 of the inner liner 16. This closes the V-shaped slots at 28 which closes the lower pocket 24 about a portion 42*a* of the shaft 42 adjacent the head 40. When the lower pocket 24 is closed, the lower end 26 of the receptacle 20 will be substantially reduced in size so that it will easily fit into a golf bag (not shown). To insure that the lower pocket 24 remains closed, the head cover 10 may be provided with cooperating elements 44 and 46 of a hook and loop fastener which are positioned proximate the edges 32 and 34.

Figure 4:
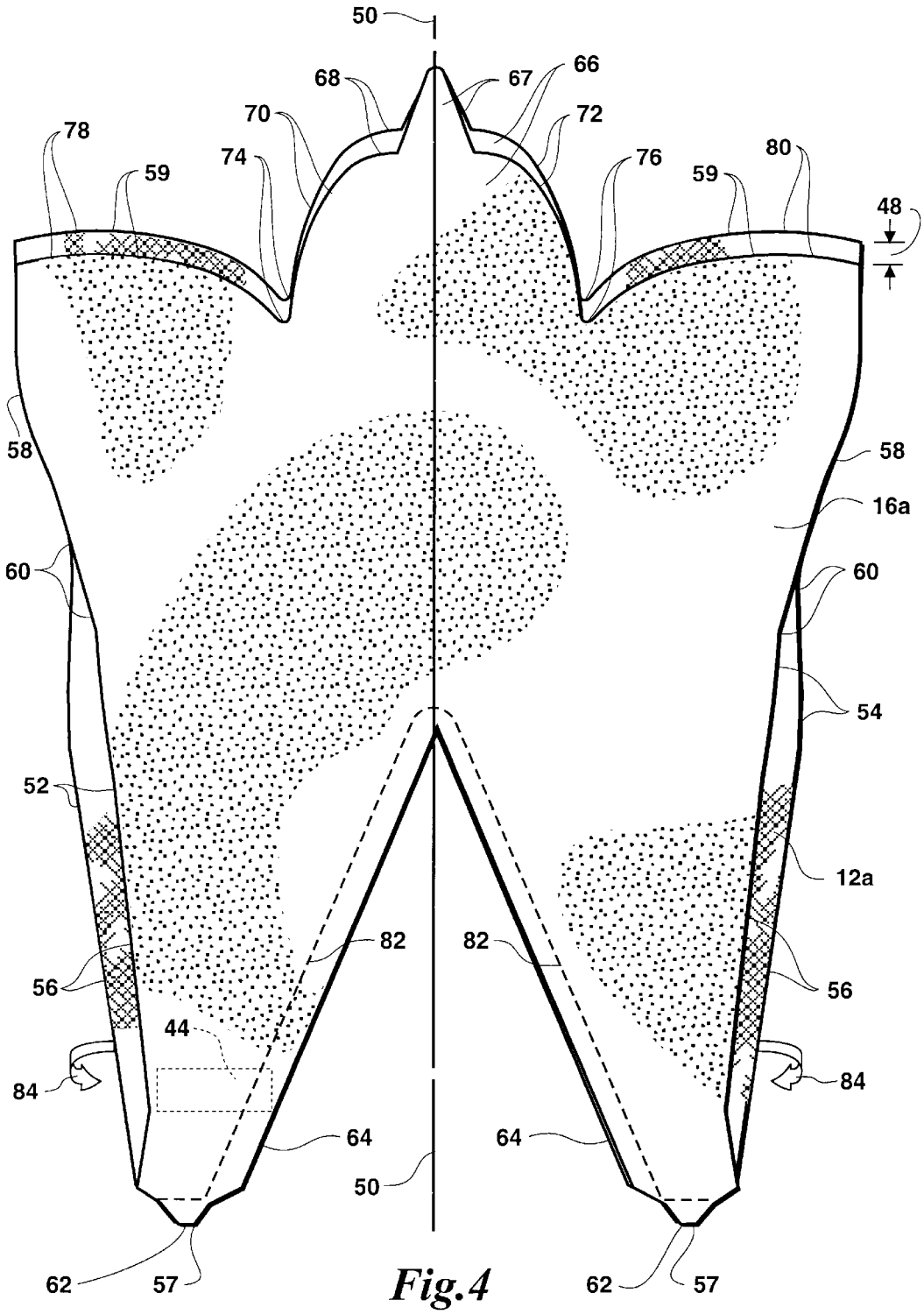
FIG. 4 is a plan view showing two sheets of flexible material which have been cut into a unique configuration in preparation for fabrication of the golf club head cover.

Referring now to FIG. 4, steps of a method of making the head cover 10 are shown. The first step includes cutting, with a suitable die (not shown), two sheets of flexible material 12*a*, 16*a* such as fabric, with the lower sheet 12*a* being used to form the outer sleeve 12, with the lower sheet 12*a* being laid flat with its outer surface facing upwardly, and the upper sheet 16*a* which will form the inner liner 16, being similarly laid flat in a superimposed position on the lower sheet 12*a*. It will be seen that the upper sheet 16*a* is longitudinally shorter than the lower sheet 12*a* as shown at 48 to provide the gap 30 between the closed upper ends of the inner liner 16 and the outer sleeve 12 as already described. The lower and upper sheets 12*a*, 16*a* will be collectively referred to as the "material". The material has a longitudinal axis 50 which bisects the material and divides it into symmetrical halves. As seen in FIG. 4, edge regions 52, 54 of the upper sheet 16*a* are spaced inwardly from the edge regions 52, 54 of the lower sheet 12*a* along at least part of their length. This results in the inner liner 16 having a smaller circumference than the outer sleeve 12 in that part of its length which assists in closing the V-shaped slots at 28 as already described. Each of the edge regions 52 and 54 of the sheets 12*a*, 16*a* are provided with a lower land segment 56 proximate what may be described as the tail end edge 57 of the material, and an upper land segment 58 proximate the opposite, or upper, end 59 thereof. An inwardly curved edge segment 60 is formed in each of the edge regions 52 and 54 intermediate the upper and lower land segments 56 and 58 respectively thereof.

The tail end edge 57 of the material is formed with relatively short land areas 62 at its opposite ends and intermediate edge segments 64 which extend upwardly and inwardly from the inner ends of the land areas 62 to form the edges 32 and 34. The upper end edge 59 of the material include protruding central flaps 66 having tabs 67 and land portions 68 on extending ends and preferably formed with outwardly curved side edge portions 70 and 72. The innermost ends of the curved side edge portions 70 and 72 form junction points 74 and 76 with the inner ends of end edge segments 78 and 80 that extend from their respective junctions 74 and 76 to the uppermost ends of the edge regions 52 and 54. The end edge segments 78 and 80 are curved to match the side edge portions 70 and 72 of the protruding central flaps 66.

When the material is cut into the above described configuration and the sheet 16*a* forming inner liner 16 is in the superimposed position atop the sheet 12*a* forming the outer sleeve 12, the material is then sewn as at 82 along the length of the tail end edge 57 of the material and this includes sewing of the intermediate edge segments 64 which form the edges 32 and 34. This step may include the insertion of the element 44 of the hook and loop fastener between the two sheets 12*a*, 16*a* so that it will be stitched in place during sewing of the seam 82.

Figure 5:
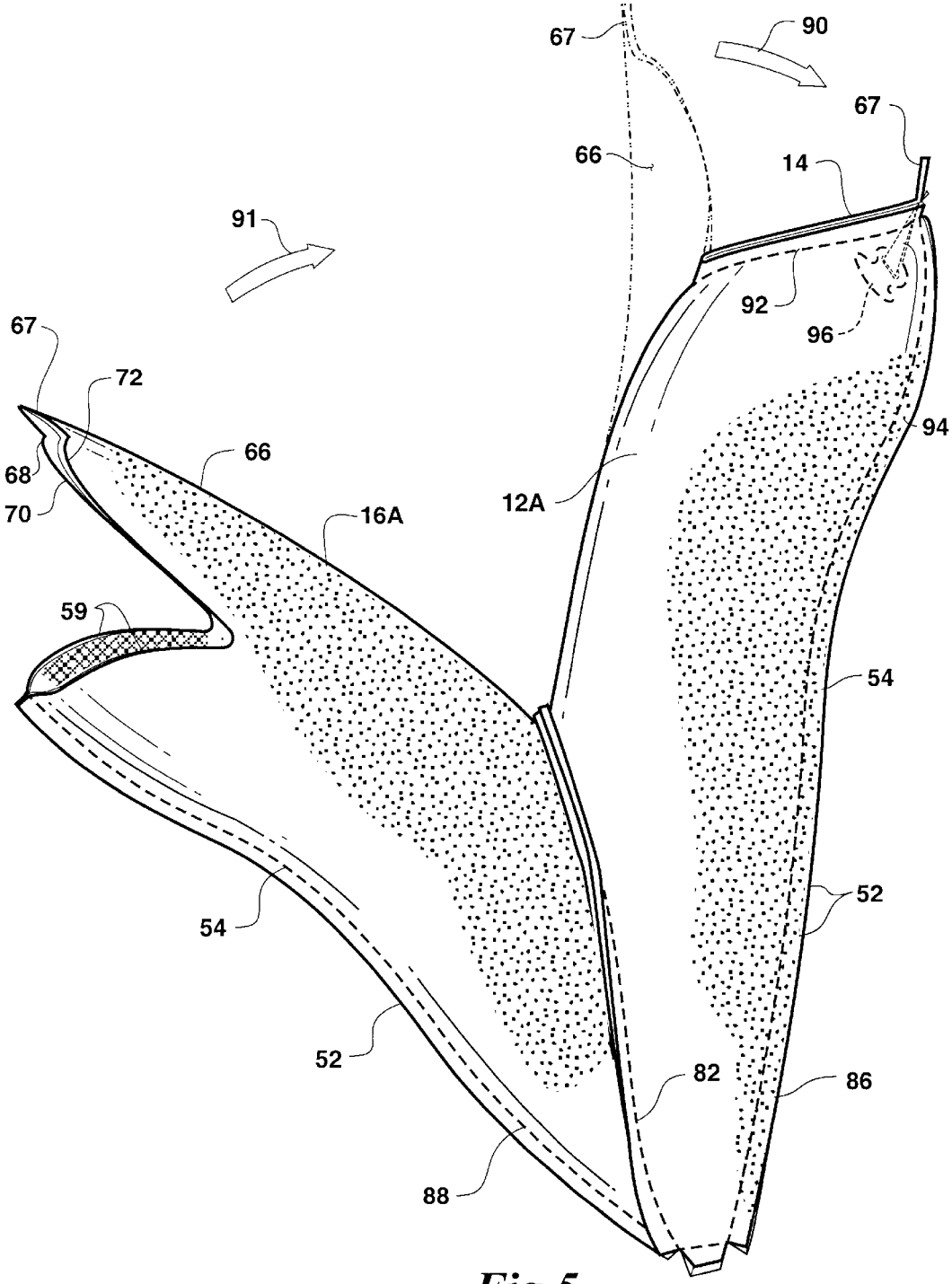
FIGS. 5–6 are elevational views showing various stages in the fabrication of the golf club head cover.

The lower sheet 12*a* of the material, that forms the outer sleeve 12, is then folded about the longitudinal axis 50 in the manner indicated by the arrows 84 in FIG. 4 until the edge regions 52 and 54 of the sheet 12*a* forming the outer sleeve 12 are in touching aligned relationship. Prior to folding the lower sheet 12*a* about the longitudinal axis 50, the upper sheet 16*a* is moved downwardly in FIG. 4 so that it is out of the way. The upper sheet 16*a* of material, that forms the inner liner 16, is folded until its edge regions 52 and 54 are in touching aligned relationship. When the sheets 12*a*, 16*a* forming the outer sleeve 12 and inner liner 16 are folded in this manner, they will be positioned relative to each other as seen in FIG. 5. The sheet 12*a* forming the outer sleeve 12 is then sewn at 86 to form a sewn seam at the aligned edge regions 52 and 54 thereof and the sheet 16*a* forming the inner liner 16 is subsequently sewn as at 88 to sew the aligned edge regions 52, 54 together.

The protruding flap 66 of the sheet 12*a* forming the outer sleeve 12 is then folded downwardly as indicated by the arrow 90 in FIG. 5 to bring the land portion 68 and the curved side edge portions 70 and 72 of the flap 66 into touching alignment with the curved end edge segments 78 and 80 formed at the upper end edge 59 thereof and those aligned edges are then sewn as at 92 to close the upper end 14 of the outer sleeve 12. The sheet 16*a* is then folded downwardly in FIG. 5 in the direction of arrow 91, and the tabs 67 are stitched to each other. When sewn as described, fabrication of the outer sleeve 12 will have been completed, however it will be in an inside-out position. It is sewn in this manner so that the seams formed along the longitudinal edges of the outer sleeve 12 and at the closed upper end 14 thereof will be inside the outer sleeve 12, and thus hidden from view, when the outer sleeve 12 is turned right-side out.

Prior to sewing the flap 66 of the outer sleeve 12 closed and turning it into the right-side-out position, a fabric strip 67 having a special connector 96 positioned thereon, is folded back upon itself to form a loop and is placed in the open upper end of the outer sleeve 12 as indicated in FIG. 5. With the fabric strip 67 and connector 96 positioned as shown, when the outer sleeve 12 is closed by stitching of the sewn seam 92, the aligned ends of the fabric strip 67 will be simultaneously stitched into that seam so as to become captively affixed to the closed upper end 14 of the outer sleeve 12.

Figure 6:
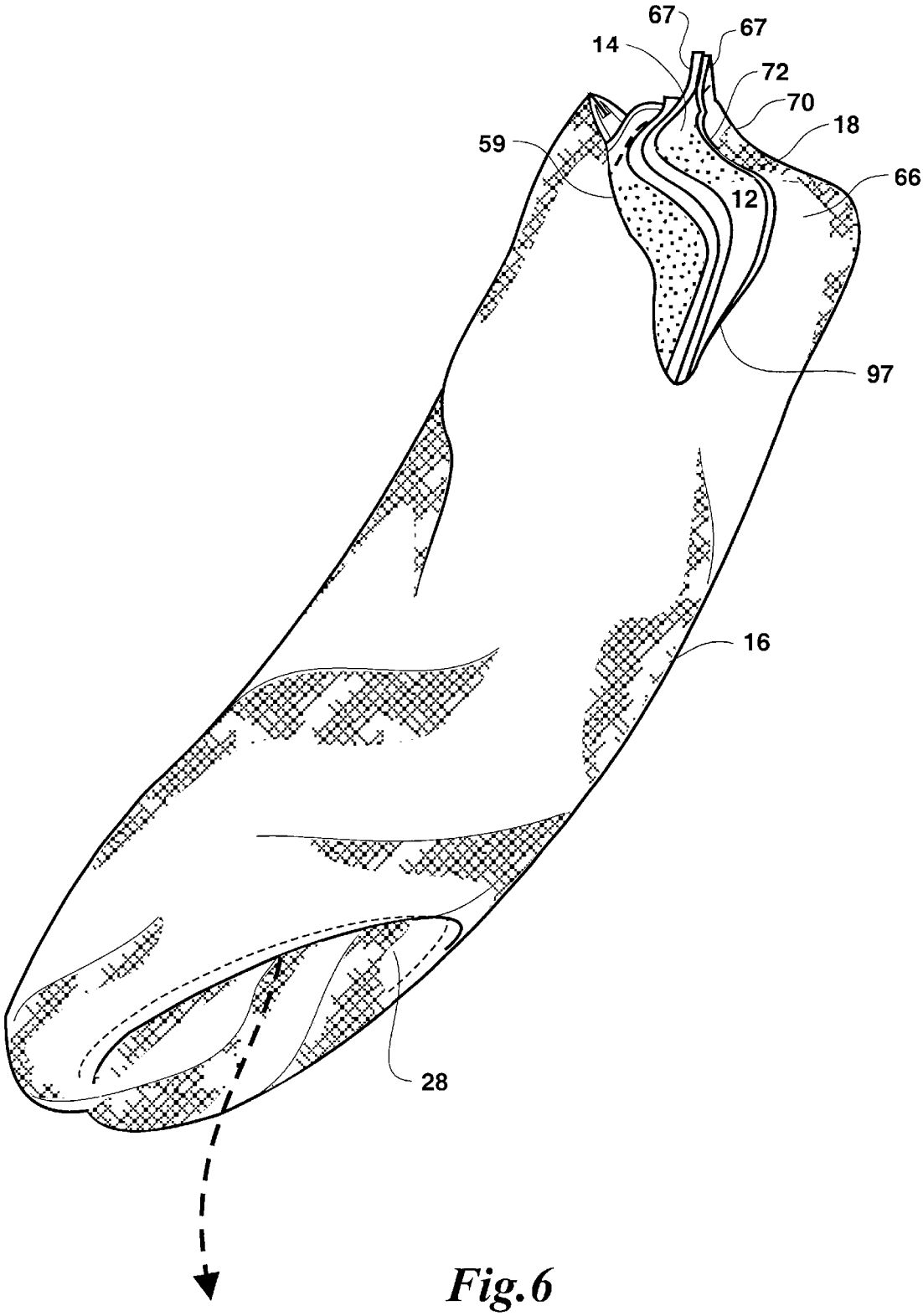

Turning the outer sleeve 12 right-side-out is the next step and this is accomplished by pushing the closed upper end 14 of the outer sleeve 12 into and through the interior of the outer sleeve 12, through the slot 28, and into the interior of the inner liner 16 to the position shown in FIG. 6. It will be understood that the position shown in FIG. 6 is a transitional position and movement of the outer sleeve 12 through the inner liner 16 is continued until the outer sleeve 12 has passed completely through the inner liner 16. The flap 66 of the inner sleeve 16 is then folded into the closed position in the manner previously described with reference to the outer sleeve 12 and sewn to form the seam 97. When the upper end 18 of the inner liner 16 is closed, fabrication of the head cover 10 is completed by pushing the inner liner 16 through the slot 28 into the interior of the outer sleeve 12 and attaching the loop portion 46 to the outer sleeve 12 as shown in FIGS. 1 and 2.

Referring again to FIG. 4, the lower and upper land segments 56 and 58 respectively and the inwardly curved segments 60 provide the edge regions 52 and 54 of the material with a special configuration. When those edge regions 52, 54 are sewn together in the manner hereinbefore described, the lower land segments 56 will shape the lower end 26 of the receptacle 20 (FIG. 3) of the head cover 10 so that it acts as a ramp which leads into a constricted area 98 between the upper and lower pockets 22, 24 formed by the inwardly curved edge segments 60, and the upper land segments 58 form the upper pocket 20 at the end 23 of the receptacle 20. When the head cover 10 is installed on a golf club 38, this ramp in the receptacle 20 will provide a smooth movement of the head cover 10 down over the golf club head 40 and into the constricted area 98 of the receptacle 20. Upon entering the constricted area 98, the person installing the head cover 10 will need to exert slightly more pulling force and the velocity of the golf club head 40 will increase upon leaving the constricted area 98 and entering the upper pocket 22. By increasing the velocity of the club head 40 as it enters the upper pocket 22, an appreciable amount of force will be exerted on the inner liner 16 which will push it upwardly to close the gap 30 between the inner liner 16 and the outer sleeve 12 and thereby close the lower pocket 24 around the shaft portion 42*a*. When the head cover 10 is removed from the golf club 38, the inner liner 16 is prevented from being pulled out of the outer sleeve 12 since the tabs 67 are connected to each other.

Figure 7:
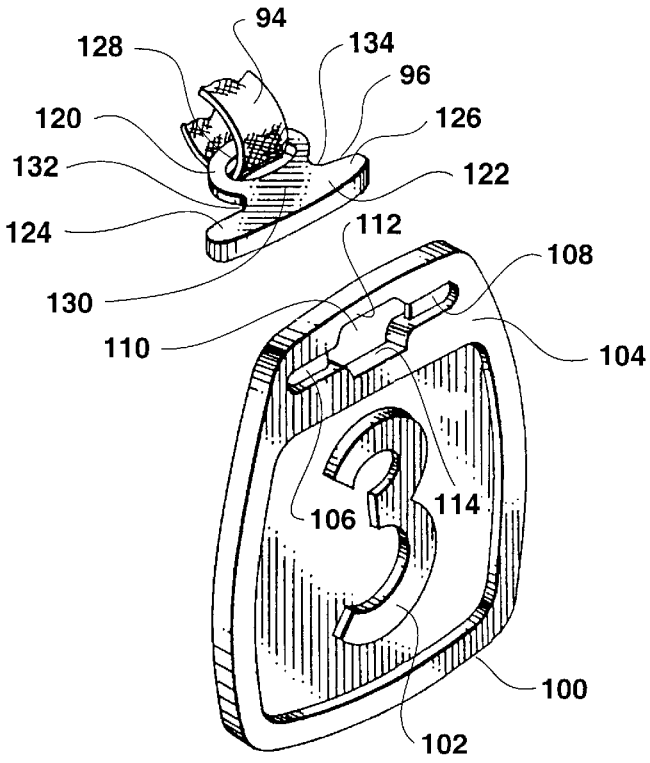
FIG. 7 is an exploded perspective view of an identification tag and a connector which is detachably mounted on the head cover.
Figure 8:
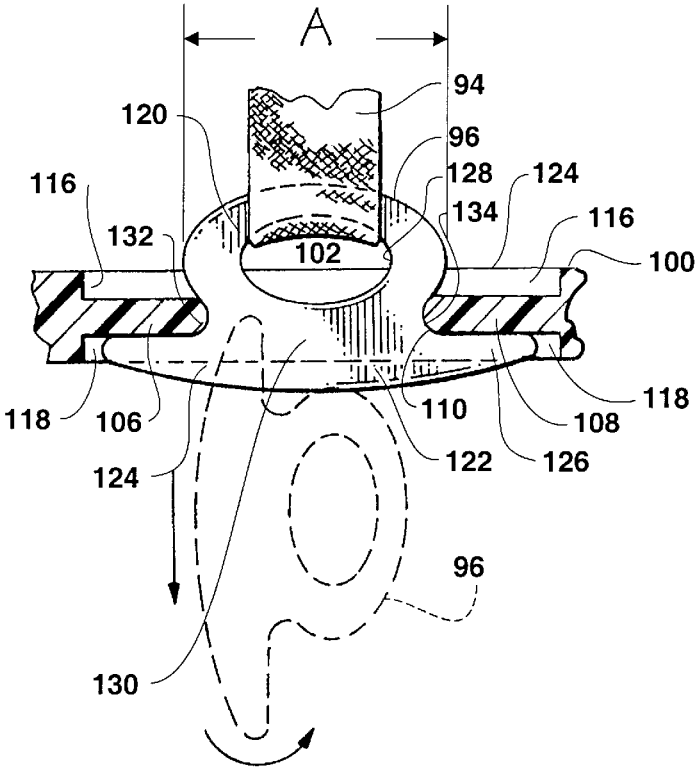
FIG. 8 is an enlarged sectional view of the identification tag and the connector.

Referring now to FIGS. 7 and 8 wherein the structural details of a detachable identification tag 100 are shown. The detachable tag 100 includes a substantially planar body of any desired shape which is molded or otherwise formed, such as from a suitable synthetic resin, and has golf club identification indicia 102 on at least one side thereof. The tag 100 is formed to define an especially configured slot 104 for demountably receiving the hereinbefore mentioned special connector 96. The slot 104 is of elongated configuration with webs 106 and 108 extending toward each other from opposite ends of the slot and the webs are of reduced thickness in comparison to the thickness of the body of the tag 100 so that the webs have the capability of being resiliently deflectable for reasons which will become apparent as this description progresses. The inwardly disposed ends of the webs 106 and 108 define the opposite ends of a generally rectangular central opening 110 formed through the tag body 100. The upper and lower longitudinal sides of the slot 104 are notched as at 112 and 114 to provide clearance for the fabric strip 94 during mounting of the tag 100 on the connector 96. In that the webs 106 and 108 are of reduced thickness, recessed cavities 116 and 118 are defined on opposite sides of each of the webs.

The connector 96, which may also be molded or otherwise formed of a suitable synthetic resin, has a body of generally T-shaped configuration including an eyelet 120 and an integral cross bar 122. The cross bar is tangentially disposed relative to the eyelet 120 to provide oppositely extending arms 124 and 126. The eyelet 120 defines an elongated opening 128 through which the fabric strip 94 is threadingly passed. The eyelet 120 is shown as being of generally oval configuration having a width dimension "A" which lies along a major axis which is parallel to the cross bar 122. It will be understood that the eyelet 120 may be of various other configurations such as circular (not shown) in which case dimension "A" would be the diameter of the circle. Therefore, it will be understood that dimension "A" will be the width of the eyelet 120 taken along a line parallel to the cross bar 122. The connector 96 has a neck 130 at the tangential junction of the eyelet 120 and the crossbar 122, and the neck has a width dimension which is less than the width dimension "A" of the eyelet to provide recesses 132 and 134 on opposite sides of the neck.

To demountably attach the identification tag 100 to the connector 96, the connector is turned sideways and pushed through the central opening 110 of the slot 104 of the tag as indicated in dashed lines in FIG. 8. After being pushed through the central opening 110 of the slot 104 in this manner, the connector is then turned through about 90 degrees of rotation to bring the cross bar 122 into parallel relationship with the slot 104 to locate the eyelet 120 proximate the central opening 110 of the slot. The width dimension "A" of the eyelet 120 is greater than the longitudinal dimension of the central opening 110 of the slot and the width dimension of the neck 130 is approximately equal thereto. Therefore after the connector 96 has been rotated as described above it will need to be forcefully pushed into the installed position. The larger width dimension "A" of the eyelet 120 will deflect the webs 106 and 108 as it passes through the temporarily enlarged central opening 110 of the slot 104, and the deflected webs will resiliently snap into the recesses 132 and 134 on opposite sides of the neck 130 of the connector 96.

By being connectable to the head cover 10 in the above described manner, the particular identification tag 100 to be installed may be selected from a plurality of such tags having various golf club indicia thereon and, the selection and installation may be accomplished at the time of purchase. Thus simplilying both the manufacturing and supplying of the product. If for any reason it should become necessary or desirable to replace an installed tag 100 with a different one, it can be easily accomplished by simply reversing the above described installation procedure.

What is claimed is:

1. A head cover for use in combination with a golf club having a head and a shaft for covering said head and a portion of said shaft adjacent said head, said head cover comprising:

an outer sleeve, formed of flexible material, said outer sleeve being elongated having a closed upper end and an open bottom end an inverted V-shaped slot extending from the open bottom end toward the closed upper end, said outer sleeve having a first longitudinal dimension;

an inner liner formed of flexible material said inner liner being elongated having a closed upper end and an open bottom end with an inverted V-shaped slot extending longitudinally from the open bottom end toward the closed upper end, said inner liner having a second longitudinal dimension;

said outer sleeve and said liner cooperating to define an elongated receptacle having an upper pocket and a lower pocket;

said inner liner disposed within said outer sleeve with the open bottom end of said inner liner and the V-shaped slot thereof beg aligned with and attached to the open bottom end and the V-shaped slot of said outer sleeve; and said second longitudinal dimension being less than said first longitudinal dimension to provide a gap between the closed upper end of said outer sleeve and the closed upper end of said liner.

2. The head cover of claim 1, wherein said elongated receptacle comprises a constricted area between said upper and lower pockets.

3. The head cover of claim 1, in combination with a detachable identification tag, said detachable identification tag comprising:

a tag of planar configuration having golf club identification indicia on at least one surface and defining a slot proximate one edge thereof;

a loop shaped fabric strip fixedly extending from the closed upper end of said outer sleeve; and a connector carried on said loop shaped fabric strip and including means in demountable frictional engagement with the slot defined by said tag to detachably attach said tag to the closed upper end of said outer sleeve.

4. The head cover of claim 3, further comprising;

said tag being configured to provide the slot thereof with a central opening the opposite ends of which are defined by a spaced apart pair of resiliently deflectable webs; and said connector includes a body having a reduced width neck portion between its opposite ends which is disposed in the slot of said tag so as to extend between the resiliently deflectable webs which define the opposite ends of the central opening thereof.

5. The head cover of claim 4, wherein the body of said connector is of planar configuration having an eyelet on one end thereof which has a width dimension slightly larger than the distance between the spaced apart webs which define the opposite ends of the central opening formed in said tag so that when the eyelet end of the body of said connector is pushed into the slot of said tag it will deflect the webs to temporarily enlarge the central opening of the slot of said tag to allow the eyelet end of said connector to pass therethrough.

* * * * *